US009978198B2

(12) United States Patent
Arai

(10) Patent No.: US 9,978,198 B2
(45) Date of Patent: May 22, 2018

(54) CHANGE MACHINE MANAGEMENT APPARATUS AND OPERATING METHOD THEREOF

(71) Applicant: TOSHIBA TEC KABUSHIKI KAISHA, Tokyo (JP)

(72) Inventor: Eisuke Arai, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/646,722

(22) Filed: Jul. 11, 2017

(65) Prior Publication Data

US 2018/0033229 A1 Feb. 1, 2018

(30) Foreign Application Priority Data

Aug. 1, 2016 (JP) ..... 2016-150962

(51) Int. Cl.
*G07D 1/02* (2006.01)
*G07D 11/00* (2006.01)

(52) U.S. Cl.
CPC ..... *G07D 11/0066* (2013.01); *G07D 1/02* (2013.01); *G07D 11/0045* (2013.01); *G07D 11/0057* (2013.01); *G07D 11/0072* (2013.01)

(58) Field of Classification Search
CPC .. G07D 1/02; G07D 1/04; G07D 1/06; G07D 9/00; G07D 11/0057; G07D 11/0072; G07F 19/00
See application file for complete search history.

(56) References Cited

U.S. PATENT DOCUMENTS 4,947,479 A * 8/1990 Kawai ..... G06Q 20/10 235/379
2006/0283685 A1* 12/2006 Cousin ..... G07D 1/02 194/217
2008/0014849 A1* 1/2008 Levasseur ..... G07D 1/02 453/16
2011/0054671 A1* 3/2011 Suzuki ..... G07F 5/24 700/219

FOREIGN PATENT DOCUMENTS

JP 2009-230680 10/2009

OTHER PUBLICATIONS

Extended European Search Report filed Jan. 3, 2018 in counterpart European Patent Application No. 17184207.3 (6 pages).

* cited by examiner

*Primary Examiner* — Mark J Beauchaine
(74) *Attorney, Agent, or Firm* — Patterson & Sheridan, LLP

(57) ABSTRACT

A change machine management apparatus includes an interface to a change machine that discharges money based on discharge data received through the interface, a display unit, and a processor programmed to create a screen display on the display unit including first, second, and third areas, each displaying a number of bills and coins for each denomination, and control the display unit to display in the first area, the number of bills and coins stored in the storage unit for each denomination, display in the second area, the number of bills and coins to be stored as a change reserve amount in the storage unit for each denomination, and display in the third area, the number of bills and coins for each denomination according to a difference between the number of bills and coins displayed in the first area and the number of bills and coins displayed in the second area.

20 Claims, 12 Drawing Sheets

FIG. 4

50

| DENOMINATION NUMBER | DENOMINATION | NUMBER-OF-BILLS-AND-COINS | AMOUNT-OF-MONEY |
|---|---|---|---|
| 1 | 10,000 | a1 | a1*10,000 |
| 2 | 5,000 | a2 | a2*5,000 |
| 3 | 2,000 | a3 | a3*2,000 |
| 4 | 1,000 | a4 | a4*1,000 |
| 5 | 500 | a5 | a5*500 |
| 6 | 100 | a6 | a6*100 |
| 7 | 50 | a7 | a7*50 |
| 8 | 10 | a8 | a8*10 |
| 9 | 5 | a9 | a9*5 |
| 10 | 1 | a10 | a10*1 |
| | CHANGE MACHINE BALANCE AMOUNT | | A |

FIG. 5

60

| DENOMINATION NUMBER | DENOMINATION | NUMBER-OF-BILLS-AND-COINS | AMOUNT-OF-MONEY |
|---|---|---|---|
| 1 | 10,000 | b1 | b1*10,000 |
| 2 | 5,000 | b2 | b2*5,000 |
| 3 | 2,000 | b3 | b3*2,000 |
| 4 | 1,000 | b4 | b4*1,000 |
| 5 | 500 | b5 | b5*500 |
| 6 | 100 | b6 | b6*100 |
| 7 | 50 | b7 | b7*50 |
| 8 | 10 | b8 | b8*10 |
| 9 | 5 | b9 | b9*5 |
| 10 | 1 | b10 | b10*1 |
| | CHANGE RESERVE AMOUNT | | B |

FIG. 6

| | | |
|---|---|---|
| 71 | POST-COLLECTION BALANCE AMOUNT | C |
| 72 | DISCHARGE AMOUNT | D |
| 73 | BALANCE AMOUNT | E |

74

| DENOMINATION NUMBER | DENOMINATION | NUMBER-OF-DISCHARGE | NUMBER-OF-DEPOSIT |
|---|---|---|---|
| 1 | 10,000 | F1 | G1 |
| 2 | 5,000 | F2 | G2 |
| 3 | 2,000 | F3 | G3 |
| 4 | 1,000 | F4 | G4 |
| 5 | 500 | F5 | G5 |
| 6 | 100 | F6 | G6 |
| 7 | 50 | F7 | G7 |
| 8 | 10 | F8 | G8 |
| 9 | 5 | F9 | G9 |
| 10 | 1 | F10 | G10 |

75

| | | | | | |
|---|---|---|---|---|---|
| m | n | p | q | r | s |

FIG. 11

50

| DENOMINATION NUMBER | DENOMINATION | NUMBER-OF-BILLS-AND-COINS | AMOUNT-OF-MONEY |
|---|---|---|---|
| 1 | 10,000 | 10 | 100,000 |
| 2 | 5,000 | 11 | 55,000 |
| 3 | 2,000 | 0 | 0 |
| 4 | 1,000 | 103 | 103,000 |
| 5 | 500 | 53 | 26,500 |
| 6 | 100 | 2 | 200 |
| 7 | 50 | 40 | 2,000 |
| 8 | 10 | 5 | 50 |
| 9 | 5 | 35 | 175 |
| 10 | 1 | 10 | 10 |
| | CHANGE MACHINE BALANCE AMOUNT | | 286,935 |

FIG. 12

50

| DENOMINATION NUMBER | DENOMINATION | NUMBER-OF-BILLS-AND-COINS | AMOUNT-OF-MONEY |
|---|---|---|---|
| 1 | 10,000 | 2 | 20,000 |
| 2 | 5,000 | 10 | 50,000 |
| 3 | 2,000 | 0 | 0 |
| 4 | 1,000 | 102 | 102,000 |
| 5 | 500 | 52 | 26,000 |
| 6 | 100 | 0 | 0 |
| 7 | 50 | 36 | 1,800 |
| 8 | 10 | 2 | 20 |
| 9 | 5 | 34 | 170 |
| 10 | 1 | 10 | 10 |
| | CHANGE MACHINE BALANCE AMOUNT | | 200,000 |

CHANGE MACHINE MANAGEMENT APPARATUS AND OPERATING METHOD THEREOF

CROSS-REFERENCE TO RELATED APPLICATION

This application is based upon and claims the benefit of priority from Japanese Patent Application No. 2016-150962, filed Aug. 1, 2016, the entire contents of which are incorporated herein by reference.

FIELD

Embodiments described herein relate generally to a change machine management apparatus and a method of operating a change machine management apparatus.

BACKGROUND

In many stores such as a mass sales store and a specialty store (hereinafter referred to as a "store"), a change machine, which discharges money as change (one or both of coins and bills) stored in a storage unit based on discharge data, is used. In a store using a change machine, normally, after closing of the store, the storage unit becomes empty by collecting the bills and coins stored in the storage unit. Before opening of the store on the next business day, bills and coins prepared in advance as a change reserve amount are inserted into the change machine, and the bills and coins are stored in the storage unit. When collecting bills and coins, in some cases, the number of bills and coins for each denomination, which is set as a change reserve amount, may remain such that the task of inserting the change reserve amount on next business day is omitted.

In recent years, there is a desire to use a change machine instead of a safe after closing of the store, by allowing bills and coins to remain in the storage unit, not as a change reserve amount. For that purpose, on the next business day, for example, a salesperson needs to check whether the number of bills and coins remaining in the storage unit is insufficient or excessive as the change reserve amount, for each denomination. In addition, a salesperson needs to insert bills and coins of the insufficient denominations into the change machine to resolve any shortage (s) thereof, and collect the surplus of bills and coins of excessive denominations from the change machine. In the related art, there is no way of allowing a salesperson to easily recognize whether the bills and coins that remain in the storage unit are insufficient or excessive as a change reserve amount.

DESCRIPTION OF THE DRAWINGS

FIG. 4 is a diagram schematically illustrating a data structure of a change machine balance table stored in an auxiliary storage device of the POS terminal.

FIG. 5 is a diagram schematically illustrating a data structure of a change reserve amount table stored in the auxiliary storage device of the POS terminal.

FIG. 6 is a diagram schematically illustrating a main work memory area formed in a RAM of the POS terminal.

FIG. 11 is a diagram illustrating an example of data of the change machine balance table before change machine balance collection processing.

FIG. 12 is a diagram illustrating an example of data of the change machine balance table after change machine balance collection processing.

DETAILED DESCRIPTION

In general, according to one embodiment, there is provided a change machine management apparatus that allows, for example, a salesperson to easily recognize whether bills and coins stored in a storage unit of a change machine are insufficient or excessive as a change reserve amount, and that facilitates preparation work of the change reserve amount.

A change machine management apparatus according to an embodiment includes an interface configured for connection with a change machine that discharges money stored in a storage unit based on discharge data received through the interface, a display unit, and a processor programmed to create a screen display on the display unit including a first area, a second area, and a third area, each of which displays a number of bills and coins for each denomination, and control the display unit to display in the first area, the number of bills and coins stored in the storage unit for each denomination, display in the second area, the number of bills and coins to be stored as a change reserve amount in the storage unit for each denomination, and display in the third area, the number of bills and coins for each denomination according to a difference between the number of bills and coins displayed in the first area and the number of bills and coins displayed in the second area.

Hereinafter, an embodiment of a change machine management apparatus that allows a salesperson to easily recognize whether bills and coins stored in a storage unit of a change machine are insufficient or excessive as a change reserve amount, and that facilitates preparation work of the change reserve amount, will be described with reference to the drawings.

Figure 1:
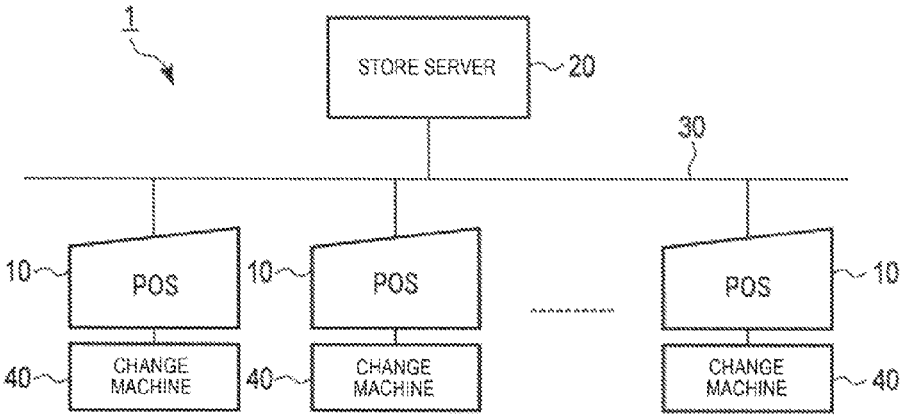
FIG. 1 is a block diagram schematically illustrating an overall configuration of a point of sale (POS) system including a change machine management apparatus according to an embodiment.

FIG. 1 is a block diagram schematically illustrating an overall configuration of a point of sales (POS) system 1 including a change machine management apparatus according to an embodiment. The POS system includes a plurality of POS terminals 10 and a store server 20, and each POS terminal 10 and the store server 20 are connected to each other via a network 30. The network 30 is, for example, a local area network (LAN). The network 30 may be a wired network or a wireless network.

The POS terminal 10 has a function of performing registration processing of a commodity purchased by a customer and a function of performing accounting processing of the commodity. The registration processing is processing of registering commodity sales data such as a sales quantity and a sales price of commodity, in a memory. In the registration processing, a price of the commodity purchased by a customer is calculated. The accounting processing is a processing of receiving input of payment data for the price and settling a payment for a commercial transaction.

The store server 20 supports the registration processing and the accounting processing performed by each POS terminal 10. In addition, the store server 20 collects and totals data of commercial transactions settled by each POS terminal 10, and manages sales of the whole store, a stock of commodity, and the like.

In addition, the POS system 1 is configured to include change machines 40 that are respectively connected to each POS terminal 10. The change machine 40 is a so-called automatic change machine that discharges a coin and a bill stored in a storage unit based on discharge data from the POS terminal 10.

Figure 2:
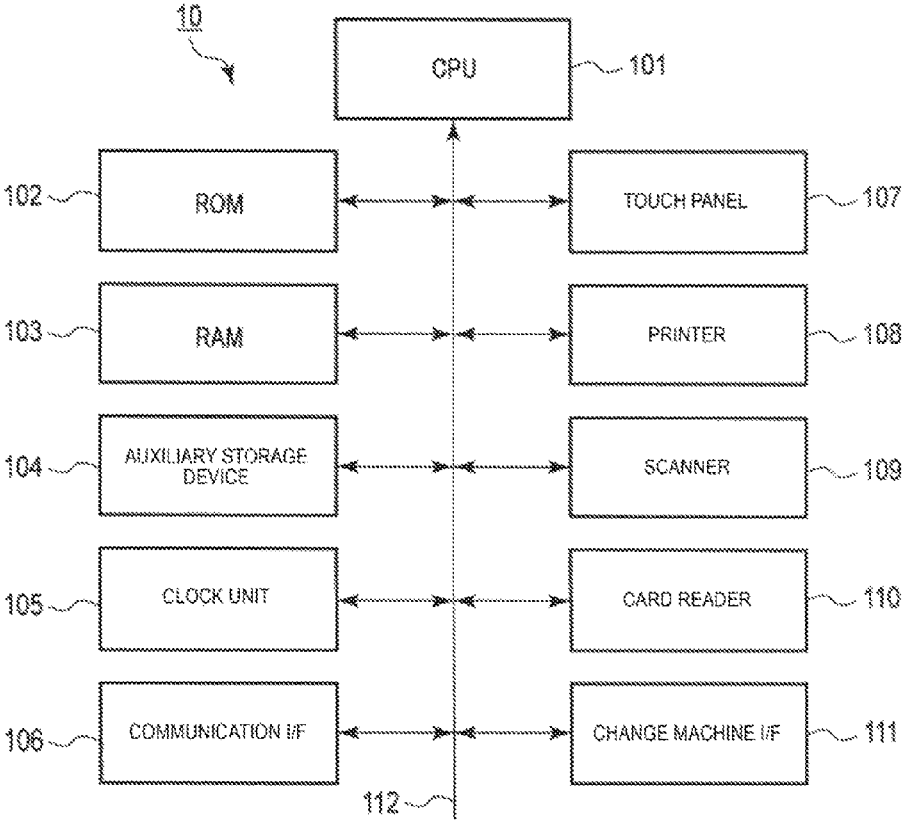
FIG. 2 is a block diagram illustrating a main circuit configuration of a POS terminal.

FIG. 2 is a block diagram illustrating a main circuit configuration of the POS terminal 10. The POS terminal 10 includes a central processing unit (CPU) 101, a read only memory (ROM) 102, a random access memory (RAM) 103, an auxiliary storage device 104, a clock unit 105, a communication interface 106, a touch panel 107, a printer 108, a scanner 109, a card reader 110, a change machine interface 111, and a system transmission line 112. The system transmission line 112 includes an address bus, a data bus, a control signal line, and the like. The system transmission line 112 connects the CPU 101, the ROM 102, the RAM 103, the auxiliary storage device 104, the clock unit 105, the communication interface 106, the touch panel 107, the printer 108, the scanner 109, the card reader 110, and the change machine interface 111 with each other such that data communication therebetween can be freely performed.

The CPU 101 corresponds to a central portion of a computer. The CPU 101 controls each unit to realize various functions as the POS terminal 10, according to an operating system and an application program.

The ROM 102 corresponds to a main memory portion of the computer. The ROM 102 stores the operating system and the application program. In some cases, the ROM 102 may store data which is required when the CPU 101 executes processing for controlling each unit.

The RAM 103 corresponds to a main memory portion of the computer. The RAM 103 stores data which is required when the CPU 101 executes processing. In addition, the RAM 103 is also used as a work area in which information is appropriately rewritten by the CPU 101.

The auxiliary storage device 104 corresponds to an auxiliary storage portion of the computer. The auxiliary storage device 104 is, for example, an electric erasable programmable read-only memory (EEPROM), a hard disc drive (HDD), a solid state drive (SSD), or the like. The auxiliary storage device 104 stores data which is used when the CPU 101 performs various processing and data which is generated when the CPU 101 performs processing. In some cases, the auxiliary storage device 104 may store the application program.

The clock unit 105 functions as a time information source of the POS terminal 10. The CPU 101 measures the current date and time based on time information measured by the clock unit 105.

The communication interface 106 transmits and receives a data signal to and from the store server 20 connected via the network 30, according to a predetermined communication protocol.

The touch panel 107 functions as an input device and a display device of the POS terminal 10.

The printer 108 performs printing on receipt paper. The printed receipt paper is issued as, for example, a purchase receipt, a credit slip, or the like. The scanner 109 optically reads, for example, a bar code attached to a commodity.

The card reader 110 reads data recorded on a card medium such as a credit card or an electronic money card, and writes data into a card medium. The change machine interface 111 transfers the transmitted and received data signal between the change machine 40 (FIG. 1) and the CPU 101.

Figure 3:
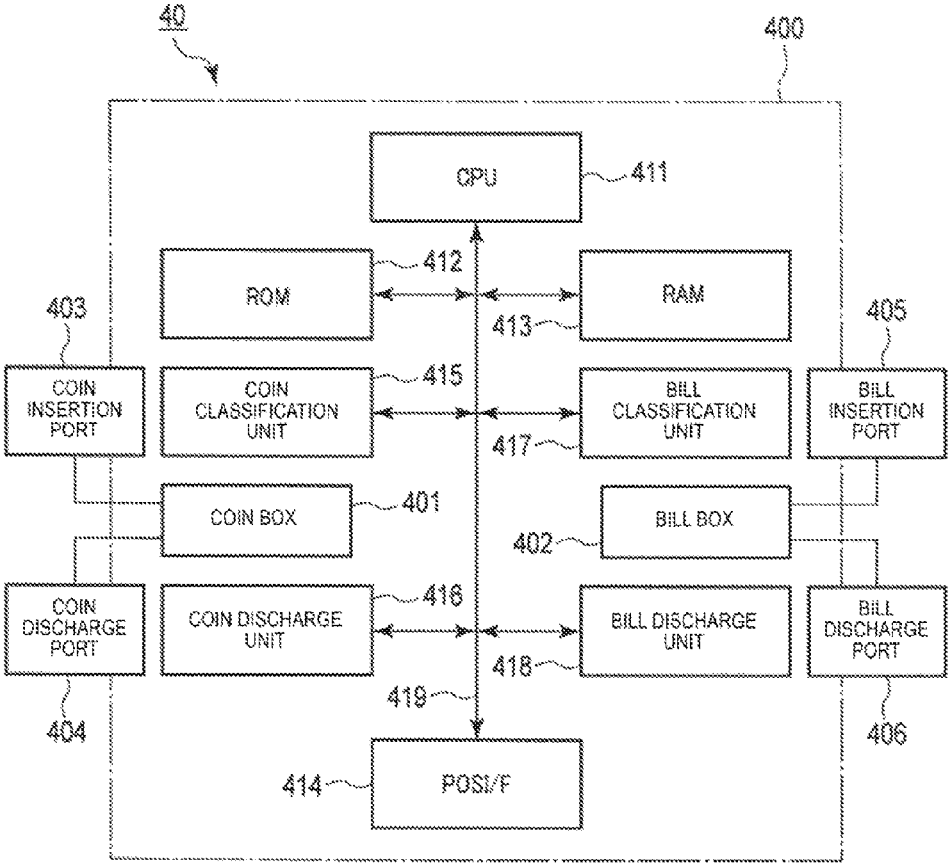
FIG. 3 is a block diagram illustrating a main configuration of a change machine.

FIG. 3 is a block diagram illustrating a main configuration of the change machine 40. The change machine 40 includes a coin box 401 and a bill box 402 in a housing 400. The coin box 401 functions as a storage unit for storing coins (500-yen coins, 100-yen coins, 50-yen coins, 10-yen coins, 5-yen coins, and 1-yen coins) of money for each denomination. The bill box 402 functions as a storage unit for storing bills (10000-yen bills, 5000-yen bills, and 1000-yen bills) of money for each denomination.

In addition, the change machine 40 includes a coin insertion port 403, a coin discharge port 404, a bill insertion port 405, and a bill discharge port 406 in the housing 400. Although not illustrated, the change machine 40 includes a coin storage mechanism, a coin discharge mechanism, a bill storage mechanism, and a bill discharge mechanism. The coin storage mechanism transports coins inserted into the coin insertion port 403, to the coin box 401, and inputs the coins into the coin box 401 by classifying the coins for each denomination. The coin discharge mechanism discharges coins taken out from the coin box 401 by a coin discharge unit 416 to be described later, from the coin discharge port 404. The bill storage mechanism transports bills inserted into the bill insertion port 405, to the bill box 402, and inputs the bills into the bill box 402 by classifying the bills for each denomination. The bill discharge mechanism discharges bills taken out from the bill box 402 by a bill discharge unit 418 to be described later, from the bill discharge port 406.

In addition, the change machine 40 includes a CPU 411, a ROM 412, a RAM 413, a POS interface 414, a coin classification unit 415, a coin discharge unit 416, a bill classification unit 417, a bill discharge unit 418, and a system transmission line 419. The system transmission line 419 includes an address bus, a data bus, a control signal line, and the like. The system transmission line 419 connects the CPU 411, the ROM 412, the RAM 413, the POS interface 414, the coin classification unit 415, the coin discharge unit 416, the bill classification unit 417, and the bill discharge unit 418 with each other such that data communication therebetween can be freely performed.

The CPU 411 corresponds to a central portion of a computer. The CPU 411 controls each unit to realize various functions as the change machine 40, according to an operating system and an application program.

The ROM 412 corresponds to a main memory portion of the computer. The ROM 412 stores the operating system and the application program. In some cases, the ROM 412 may store data which is required when the CPU 411 executes processing for controlling each unit.

The RAM 413 corresponds to a main memory portion of the computer. The RAM 413 stores data which is required when the CPU 411 executes processing. In addition, the RAM 413 is also used as a work area in which information is appropriately rewritten by the CPU 411.

The POS interface 414 transfers the transmitted and received data signal between the POS terminal 10 and the CPU 411.

The coin classification unit 415 classifies the coins transported by the coin storage mechanism one by one, and specifies the denominations of the coins. The coin classification unit 415 notifies the CPU 411 of denomination data of the specified coins.

The coin discharge unit 416 takes out, from the coin box 401, coins of the corresponding denomination, by the number of discharge, according to denomination-classified discharge data provided from the CPU 411.

The bill classification unit 417 classifies the bills transported by the bill storage mechanism one by one, and specifies the denominations of the bills. The bill classification unit 417 notifies the CPU 411 of denomination data of the specified bills.

The bill discharge unit 418 takes out, from the bill box 402, bills of the corresponding denomination, by the number of discharge, according to denomination-classified discharge data provided from the CPU 411.

When a bar code of a commodity is read by the scanner 109, the CPU 101 of the POS terminal 10 connected to the change machine 40 with such a configuration analyzes the bar code and obtains a commodity identification code. The CPU 101 reads commodity data such as a commodity name and a price, which is set in a database associated with the commodity identification code, and generates commodity sales data based on the commodity data. The CPU 101 registers the commodity sales data in a memory.

In addition, when completion of registration of one commercial transaction is instructed via the touch panel 107, the CPU 101 calculates a charged amount of the commercial transaction and displays the charged amount on the touch panel 107. Thereafter, when denomination data of the bills inserted into the bill insertion port 405 of the change machine 40 and denomination data of the coins inserted into the coin insertion port 403 are received via the change machine interface 111, the CPU 101 calculates an amount of cash inserted into the change machine 40 based on these denomination data. When it is detected that cash equal to or more than the charged amount is input to the change machine 40, the CPU 101 calculates a change amount and generates discharge data corresponding to the change amount. The CPU 101 transmits the discharge data to the change machine 40 via the change machine interface 111.

When the discharge data is received, the CPU 411 of the change machine 40 determines the number of discharge (coins or bills) for each denomination, based on the discharge data. The CPU 411 instructs the coin discharge unit 416 and the bill discharge unit 418 to eject the number of discharge for each denomination. Thus, money (a coin or a bill) corresponding to the change amount is discharged from the coin discharge port 404 and the bill discharge port 406 of the change machine 40.

The POS terminal 10 has a function as a change machine management apparatus that manages the change machine 40, in addition to the function of performing registration processing of commodities and accounting processing of commodities. In order to realize the function as the change machine management apparatus, the POS terminal 10 stores a change machine balance table 50 with a data structure illustrated in FIG. 4 and a change reserve amount table 60 with a data structure illustrated in FIG. 5, in the auxiliary storage device 104.

The change machine balance table 50 includes a record area which is divided into a denomination number field, a denomination field, a number-of-bills-and-coins field, and an amount-of-money field, and a total area of the amount-of-money field. The denomination number field of the record area stores a series of denomination numbers from "1" to "10" in order, and the denomination field stores values indicating denominations. In the present embodiment, the values indicating denominations are stored in the denomination field in descending order of the amount of money. That is, in the denomination field, a value "10,000" indicating the maximum denomination amount is stored in correlation with the denomination number "1", and a value "1" indicating the minimum denomination amount is stored in correlation with the denomination number "10". The maximum value "10" of the denomination number is a value based on the fact that, in the present embodiment, there are ten kinds of denominations of money which can be stored in the coin box 401 and the bill box 402. Additionally, for example, when there are nine kinds of denominations of money, the maximum value of the denomination number is "9".

In addition, in the change machine balance table 50, when the corresponding denomination of money is a bill, the number-of-bills-and-coins field stores the number of bills stored in the bill box 402. The amount-of-money field stores the amount of money corresponding to the number of bills. Similarly, when the corresponding denomination of money is a coin, the number-of-bills-and-coins field stores the number of coins stored in the coin box 401. In addition, the amount-of-money field stores the amount of money corresponding to the number of coins. The total area stores the total amount of money of the values which are respectively stored in the amount-of-money field of the record area. That is, the amount of money in the total area is the total amount of money respectively stored in the coin box 401 and the bill box 402 of the change machine 40, so-called a change machine balance amount A.

Additionally, the function of counting the number of coins stored in the coin box 401 and the number of bills stored in the bill box 402 for each denomination, is well known. This well-known technique is also used in the present embodiment, and thus the description thereof will be omitted here.

The change reserve amount table 60 includes a record area which is divided into a denomination number field, a denomination field, a number-of-bills-and-coins field, and an amount-of-money field, and a total area of the amount-of-money field. Similarly to the change machine balance table 50, the denomination number field of the record area stores a series of denomination numbers from "1" to "10", and the denomination field stores values indicating denominations in descending order of the amount of money.

In addition, in the change reserve amount table 60, when the corresponding denomination of money is a bill, the number-of-bills-and-coins field stores the number of bills stored in the bill box 402 as a change reserve amount. The amount-of-money field stores the amount of money corresponding to the number of bills. Similarly, when the corresponding denomination of money is a coin, the number-of-bills-and-coins field stores the number of coins stored in the coin box 401 as a change reserve amount. In addition, the amount-of-money field stores the amount of money corresponding to the number of coins. The total area stores the total amount of money of the values which are respectively stored in the amount-of-money field of the record area. That is, the amount of money in the total area is the total amount of coins and bills respectively stored in the coin box 401 and the bill box 402 as a change reserve amount before opening of a store, so-called a change reserve amount B.

Additionally, for example, after closing of a store on each business day, the number of each denomination of coins and bills for the next business day as a change reserve amount is distributed to each POS terminal 10 from the store server 20, and is set in the number-of-bills-and-coins field. The timing at which the number of each denomination of coins and bills as a change reserve amount is distributed to the POS terminal 10 is not limited to the timing after closing of a store on each business day. For example, the number of each denomination for one week may be distributed from the store server 20 to each POS terminal 10, and may be stored in the auxiliary storage device 104. In this case, before opening of a store on each business day, the CPU 101 of each POS terminal 10 acquires the number of each denomination for the day of the corresponding business day, and sets the number of each denomination in the number-of-bills-and-coins field. In addition, the number of each denomination as a change reserve amount may be fixedly set.

Further, the POS terminal 10 includes work memory areas 71, 72, 73, 74, and 75 with a data structure illustrated in FIG. 6, in the RAM 103 (FIG. 2), in order to function as the change machine management apparatus.

The work memory area 71 is an area for storing a post-collection balance amount C. The post-collection balance amount C is an amount of money remaining in the change machine 40 without being collected after closing of a store on each business day. It is not necessary that the post-collection balance amount C matches with the change reserve amount B; however, the post-collection balance amount C may match with the change reserve amount B. The post-collection balance amount C is appropriately distributed from the store server 20 to each POS terminal 10, and is stored in the work memory area 71. Alternatively, amount data which is input by operation of the touch panel 107 may be stored in the work memory area 71 as the post-collection balance amount C. The work memory area 71 is hereinafter referred to as a post-collection balance memory 71.

The work memory area 72 is an area for storing a discharge amount D. The discharge amount D is an amount of money discharged from the change machine 40. The work memory area 72 is hereinafter referred to as a discharge amount memory 72.

The work memory area 73 is an area for storing a balance amount E. The balance amount E is the balance of the discharge amount. The work memory area 73 is hereinafter referred to as a balance amount memory 73.

The work memory area 74 includes a record area which is divided into a denomination number field, a denomination field, a number-of-discharge field, and a number-of-deposit field. Similarly to the change machine balance table 50 or the change reserve amount table 60, the denomination number field of the record area stores a series of denomination numbers from "1" to "10", and the denomination field stores values indicating denominations in descending order of the amount of money. The work memory area 74 is hereinafter referred to as a number-of-discharge-and-deposit table 74.

The work memory area 75 is an area for storing variables m, n, p, q, r, and s, respectively. The work memory area 75 is hereinafter referred to as a variable memory 75.

Figure 7:
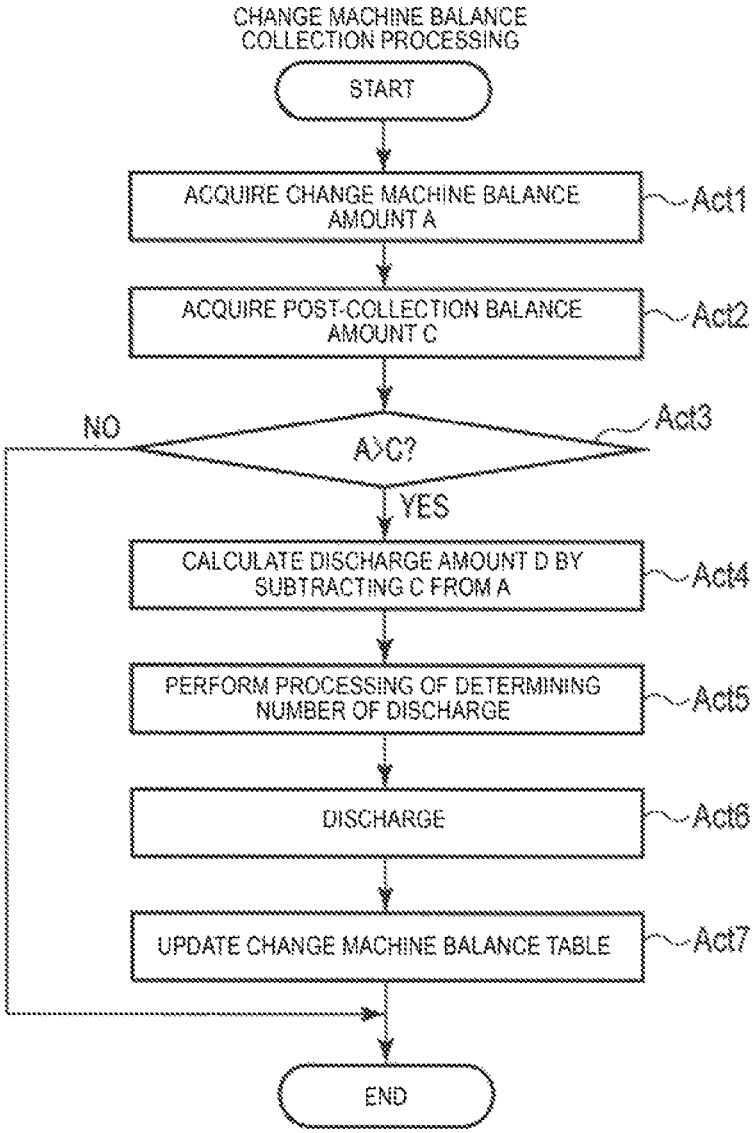
FIG. 7 is a flowchart illustrating a main procedure of change machine balance collection processing executed by a CPU of the POS terminal.
Figure 8:
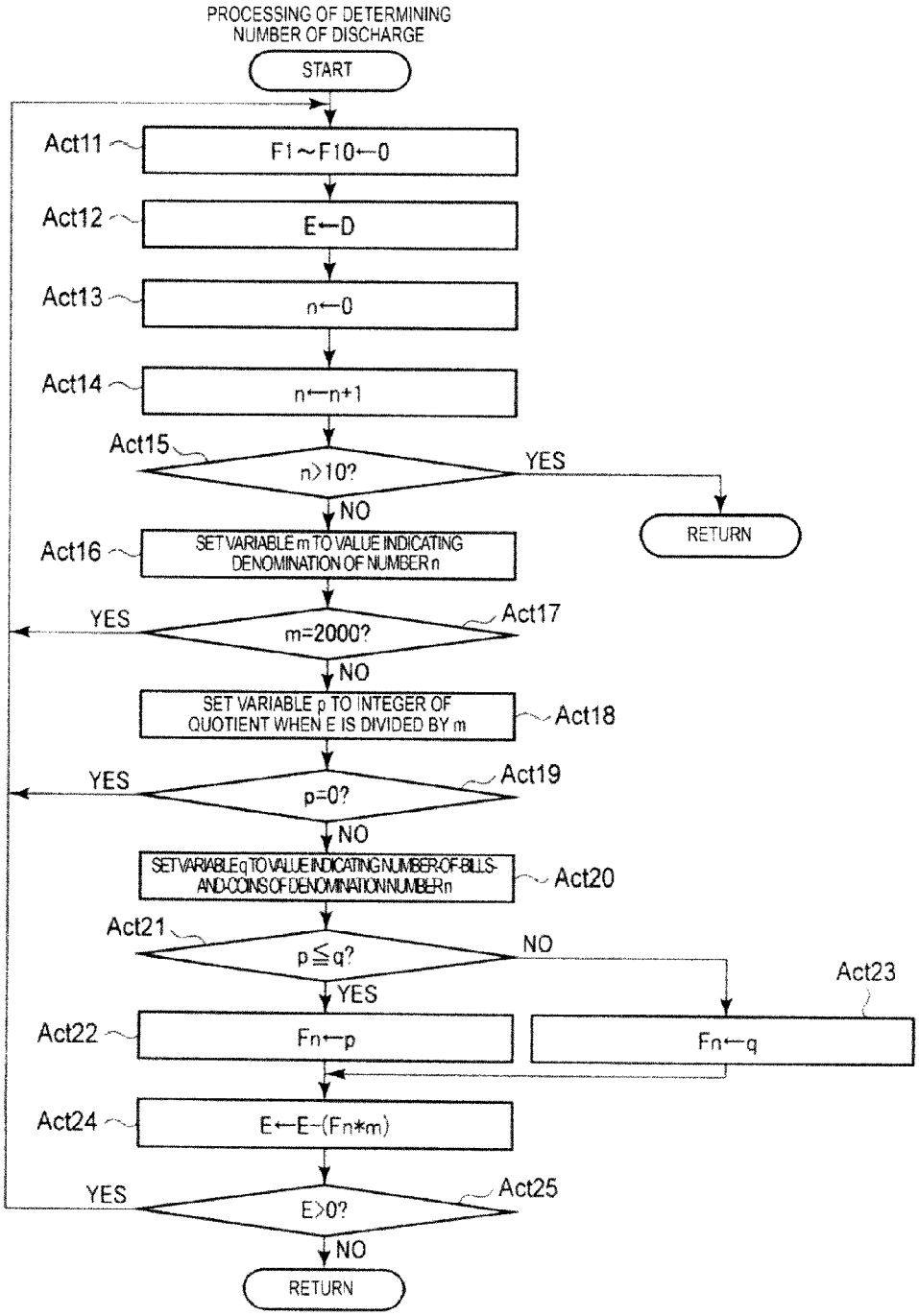
FIG. 8 is a flowchart specifically illustrating a procedure of processing of determining the number of discharges, in the procedure illustrated in FIG. 7.
Figure 9:
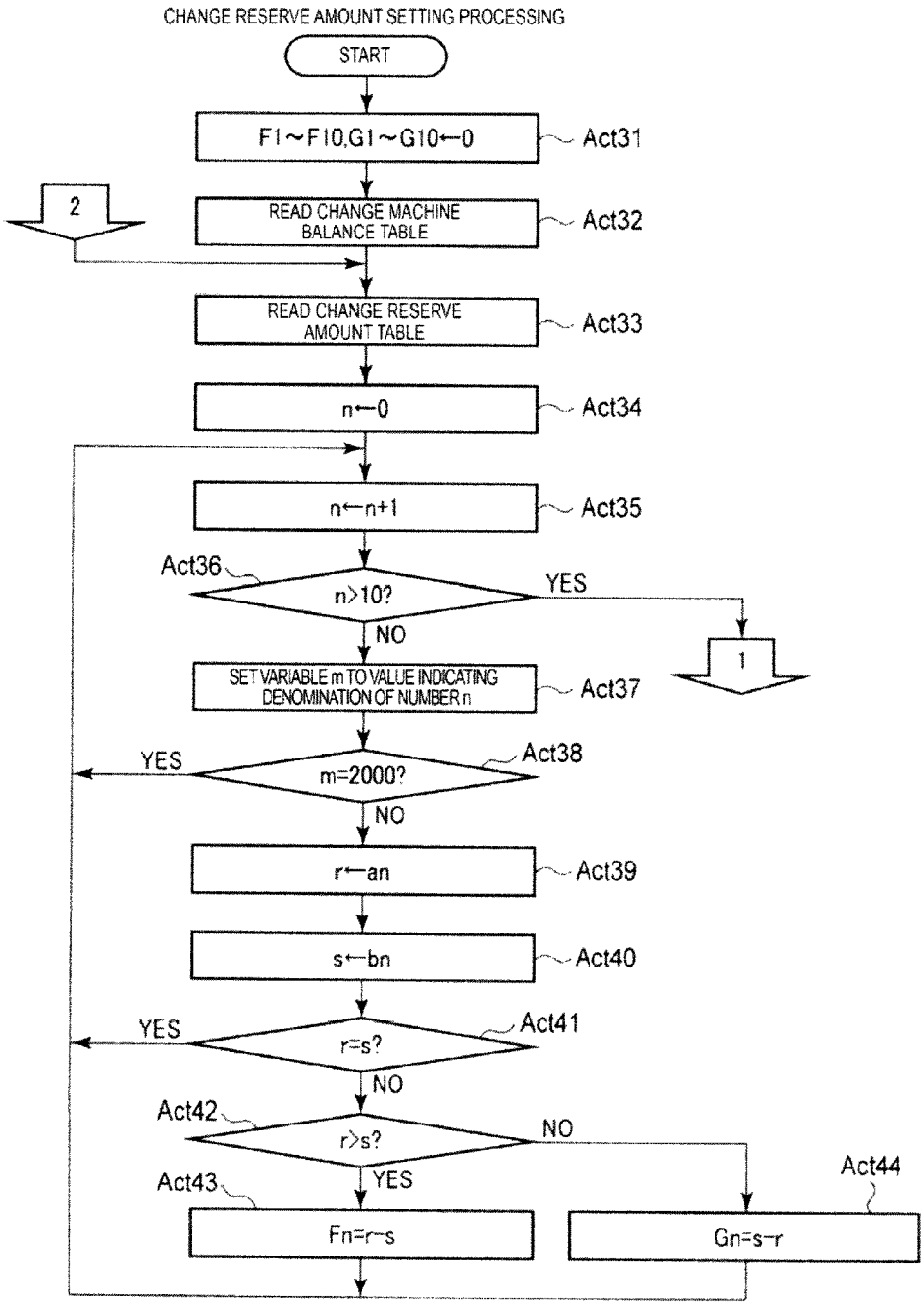
FIG. 9 is a flowchart illustrating a main procedure of change reserve amount setting processing executed by the CPU of the POS terminal.
Figure 10:
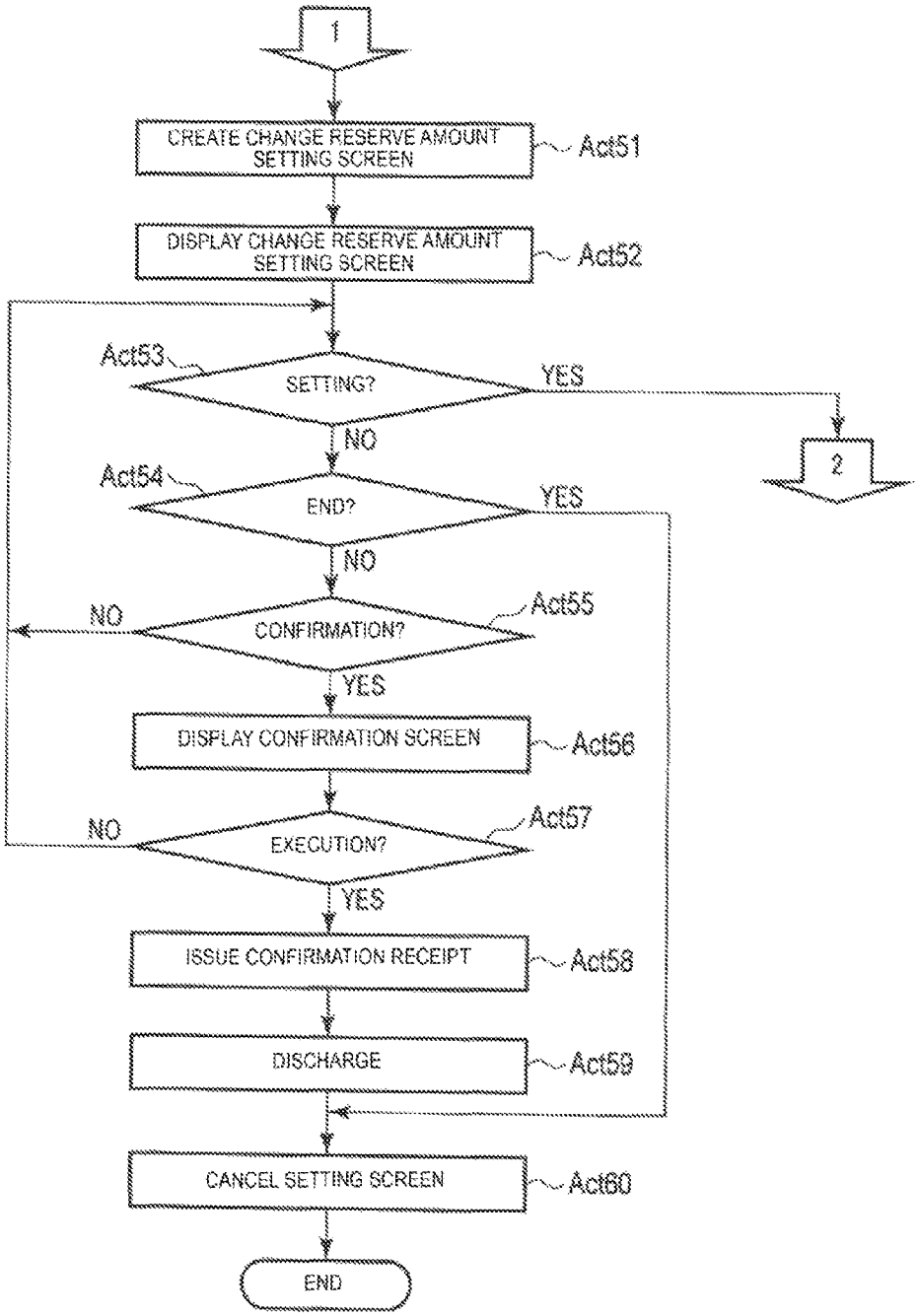
FIG. 10 is a flowchart illustrating a main procedure of change reserve amount setting processing executed by the CPU of the POS terminal.

Thus, in the POS terminal 10, the CPU 101 executes information processing according to procedures illustrated in flowcharts of FIGS. 7 to 10, according to a change machine management program stored in the ROM 102 or the auxiliary storage device 104. Additionally, FIG. 7 is a flowchart illustrating main procedures of change machine balance collection processing which is executed after closing of a store on each business day. FIG. 8 is a flowchart specifically illustrating procedures of processing of determining the number of discharge, in the procedures illustrated in FIG. 7. FIGS. 9 and 10 are flowcharts illustrating main procedures of change reserve amount setting processing which is executed before opening of a store on each business day. The contents of the processing to be described below that are illustrated in FIGS. 7 to 10 are merely presented as an example, and various processing or screens can be appropriately used as long as similar results can be obtained.

Hereinafter, functions of the POS terminal 10 as a change machine management apparatus will be described in detail with reference to the flowcharts of FIGS. 7 to 10.

In the POS terminal 10, change machine balance collection processing is assigned to one job menu among job menus to be executed after closing of a store. When change machine balance collection processing is selected, among the job menus after closing of a store, which are displayed on the touch panel 107, the CPU 101 starts information processing of the procedures illustrated in the flowchart of FIG. 7.

First, in Act 1, the CPU 101 reads the change machine balance table 50 from the auxiliary storage device 104. The CPU 101 acquires a change machine balance amount A from the total area of the change machine balance table 50. In addition, in Act 2, the CPU 101 acquires a post-collection balance amount C from the post-collection balance memory 71. The CPU 101 may firstly acquire a post-collection balance amount C and then acquire a change machine balance amount A.

When processes of Act 1 and Act 2 are ended, in Act 3, the CPU 101 compares the change machine balance amount A with the post-collection balance amount C. Here, when the post-collection balance amount C is equal to or greater than the change machine balance amount A, it is unnecessary to collect money from the change machine 40. In this case (NO in Act 3), the CPU 101 ends change machine balance collection processing.

On the other hand, in the comparison of Act 3, when the post-collection balance amount C is less than the change machine balance amount A, it is necessary to collect money from the change machine 40. In this case (YES in Act 3), in Act 4, the CPU 101 calculates a discharge amount D by subtracting the post-collection balance amount C from the change machine balance amount A, and stores the discharge amount D in the discharge amount memory 72. Next, in Act 5, the CPU 101 executes processing of determining the number of discharge, based on the procedures illustrated in the flowchart of FIG. 8.

That is, in Act 11 (FIG. 8), the CPU 101 initializes all values F1 to F10 of the number-of-discharge field in the number-of-discharge-and-deposit table 74, with "0". In addition, in Act 12, the CPU 101 copies the discharge amount D stored in the discharge amount memory 72 into the balance amount memory 73. The CPU 101 may first copy the discharge amount D into the balance amount memory 73, and then initialize values F1 to F10 of the number-of-discharge field.

When processes of Act 11 and Act 12 are ended, in Act 13, the CPU 101 sets a variable n of the variable memory 75, to "0". Next, in Act 14, the CPU 101 adds up the variable n by 1. In Act 15, the CPU 101 confirms whether or not the variable n exceeds the maximum value "10" of the denomination number.

When the variable n does not exceed the maximum value 10 of the denomination number (NO in Act 15), in Act 16, the CPU 101 acquires a value indicating a denomination of a record of a denomination number n, from the number-of-discharge-and-deposit table 74 (FIG. 6). Then, the CPU 101 replaces a variable m in the variable memory 75 with a value indicating the denomination. For example, when the variable n is "1", that is, the denomination number is "1", the variable m is replaced with the value "10000" indicating the denomination.

In Act 17, the CPU 101 confirms whether or not the variable m is "2000". The change machine 40 does not use a 2000-yen bill as change. Thus, in the present embodiment, 2000-yen bills inserted from the bill insertion port 405 are collected without being stored in the bill box 402. Therefore, in Act 17, when the variable m is "2000" (YES in Act 17), the CPU 101 returns to the process of Act 14 without executing the process of Act 18 and the subsequent processes.

In Act 17, when it is confirmed that the variable m is not "2000" (NO in Act 17), in the Act 18, the CPU 101 divides a balance amount E in the balance amount memory 73 by the variable m, and obtains an integer of the quotient in the result of division. That is, the CPU 101 calculates, in order to discharge the balance amount E, the required maximum number of bills and coins of the denomination of the variable m. Then, the CPU 101 replaces a variable p in the variable memory 75 with the integer.

In Act 19, the CPU 101 confirms whether or not the variable p is "0". Ina case where the variable p is "0", when discharging the balance amount E, bills and coins of the denomination of the variable m are unnecessary. In this case (YES in Act 19), the CPU 101 returns to the process of Act 14 without executing the process of Act 20 and the subsequent processes.

In Act 19, when it is confirmed that the variable p is not "0" (NO in Act 19), in Act 20, the CPU 101 acquires a number-of-bills-and-coins of the record of the denomination number n, from the change machine balance table 50. Then, the CPU 101 replaces a variable q in the variable memory 75 with the number-of-bills-and-coins of the record of the denomination number n. In Act 21, the CPU 101 compares the variable p with the variable q.

Here, when the variable p is equal to or less than the variable q, in the change machine 40, for the bills or coins of the denomination of the variable m, the maximum number of bills or coins required for discharging the balance amount E, remains. In this case (YES in Act 21), in Act 22, the CPU 101 replaces a value of the number-of-discharge field corresponding to the variable n in the number-of-discharge-and-deposit table 74, that is, so-called a number-of-discharge Fn, with the variable p. On the other hand, when the variable p is greater than the variable q, in the change machine 40, for the bills or coins of the denomination of the variable m, the maximum number of bills or coins required for discharging the balance amount E, does not remain. In this case (NO in Act 21), in Act 23, the CPU 101 replaces the number-of-discharge Fn with the variable q.

When process of Act 22 or process of Act 23 is ended, in Act 24, the CPU 101 updates the balance amount E. That is, the CPU 101 subtracts, from the balance amount E, the amount of money obtained by multiplying the number-of-discharge Fn by the variable m, and overwrites the subtracted value in the balance amount memory 73 as a updated balance amount E. Then, in Act 25, the CPU 101 confirms whether or not the updated balance amount E is greater than "0". When the updated balance amount E is greater than "0" (YES in Act 25), that is, when there is a balance amount of the discharge amount, the CPU 101 returns to the process of Act 14.

Thereafter, the CPU 101 repeatedly executes the processes of Act 15 to Act 25 each time the variable n is increased by "1" in Act 14. When the variable n exceeds the maximum value 10 of the denomination number (YES in Act 15), or when the balance amount E is equal to or less than "0" (NO in Act 25), the CPU 101 ends processing of determining the number of discharge.

Here, the operation of the POS terminal 10 when executing processing of determining the number of discharge will be described with a specific example.

FIG. 11 illustrates an example of data of the change machine balance table 50 before change machine balance collection processing is started. In this example of data, when the post-collection balance amount C is set to 200,000 yen, the discharge amount D is set to 86,935 yen.

At this stage, when processing of determining the number of discharge is started, in the POS terminal 10, first, the balance amount E is set to 86,935 yen. When the variable n is set to "1", the variable m is set to "10000". Therefore, the variable p is set to "8", and the variable q is set to "10". That is, the variable p is equal to or less than the variable q, and thus the number-of-discharge F1 of the number-of-discharge-and-deposit table 74 is set to "8". In addition, the balance amount E is set to 6,935 yen.

Next, when the variable n is set to "2", the variable m is set to "5000". Therefore, the variable p is set to "1", and the variable q is set to "11". That is, the variable p is equal to or less than the variable q, and thus the number-of-discharge F2 of the number-of-discharge-and-deposit table 74 is set to "1". In addition, the balance amount E is set to 1,935 yen.

Next, when the variable n is set to "3", the variable m is set to "2000". Therefore, the process of Act 18 and the subsequent processes are not executed. Accordingly, the number-of-discharge F3 of the number-of-discharge-and-deposit table 74 remains "0". In addition, the balance amount E does not change from 1,935 yen.

Next, when the variable n is set to "4", the variable m is set to "1000". Therefore, the variable p is set to "1", and the variable q is set to "103". That is, the variable p is equal to or less than the variable q, and thus the number-of-discharge F4 of the number-of-discharge-and-deposit table 74 is set to "1". In addition, the balance amount E is set to 935 yen.

Next, when the variable n is set to "5", the variable m is set to "500". Therefore, the variable p is set to "1", and the variable q is set to "53". That is, the variable p is equal to or less than the variable q, and thus the number-of-discharge F5 of the number-of-discharge-and-deposit table 74 is set to "1". In addition, the balance amount E is set to 435 yen.

Next, when the variable n is set to "6", the variable m is set to "100". Therefore, the variable p is set to "4", and the variable q is set to "2". That is, the variable p is greater than the variable q, and thus the number-of-discharge F6 of the number-of-discharge-and-deposit table 74 is set to "2". In addition, the balance amount E is set to 235 yen.

Next, when the variable n is set to "7", the variable m is set to "50". Therefore, the variable p is set to "4", and the variable q is set to "40". That is, the variable p is equal to or less than the variable q, and thus the number-of-discharge F7 of the number-of-discharge-and-deposit table 74 is set to "4". In addition, the balance amount E is set to 35 yen.

Next, when the variable n is set to "8", the variable m is set to "10". Therefore, the variable p is set to "3", and the variable q is set to "5". That is, the variable p is equal to or less than the variable q, and thus the number-of-discharge F8 of the number-of-discharge-and-deposit table 74 is set to "3". In addition, the balance amount E is set to 5 yen.

Next, when the variable n is set to "9", the variable m is set to "5". Therefore, the variable p is set to "1", and the variable q is set to "35". That is, the variable p is equal to or less than the variable q, and thus the number-of-discharge F9 of the number-of-discharge-and-deposit table 74 is set to "1". In addition, the balance amount E is set to 0 yen. The balance amount E becomes "0", and thus the POS terminal 10 ends processing of determining the number of discharge. As a result, the number-of-discharge F10 of the number-of-discharge-and-deposit table 74 remains "0".

When processing of determining the number of discharge is ended, the CPU 101 returns to the change machine balance collection processing of FIG. 7. In Act 6, the CPU 101 executes discharge processing. In other words, the CPU 101 generates discharge data including the number-of-discharge F1 to F10 of each denomination that are stored in the number-of-discharge-and-deposit table 74. The CPU 101 transmits the discharge data to the change machine 40 via the change machine interface 111.

As a result, bills and coins of the number-of-discharge F1 to F10 included in the discharge data are discharged from the change machine 40. For example, when processing of determining the number of discharge, which is described above in the specific example, is executed, from the change machine 40, eight 10,000-yen bills, one 5,000-yen bill, one 1,000-yen bill, one 500-yen coin, two 100-yen coins, four 50-yen coins, three 10-yen coins, and one 5-yen coin are discharged.

After the discharge data is transmitted to the change machine 40, in Act 7, the CPU 101 updates the change machine balance table 50 (FIG. 4). In other words, the CPU 101 changes the values of the number-of-bills-and-coins field, the amount-of-money field, and the total area of the change machine balance table 50, into values after bills and coins corresponding to the discharge data are discharged from the change machine 40. Then, the CPU 101 overwrites and stores the change machine balance table 50 in which the values of the number-of-bills-and-coins field, the amount-of-money field, and the total area are changed, in the auxiliary storage device 104.

FIG. 12 illustrates that, after eight 10,000-yen bills, one 5,000-yen bill, one 1,000-yen bill, one 500-yen coin, two 100-yen coins, four 50-yen coins, three 10-yen coins, and one 5-yen coin are discharged, the change machine balance table 50 is updated from the state of the change machine balance table 50 illustrated in FIG. 11. That is, FIG. 12 illustrates that, after the change machine balance collection processing, in the change machine 40, two 10,000-yen bills, ten 5,000-yen bills, 102 1,000-yen bills, 52 500-yen coins, 36 50-yen coins, two 10-yen coins, 34 5-yen coins, and ten 1-yen coins remain, and the change machine balance amount is set to 200,000 yen.

In the POS terminal 10, change reserve amount setting processing is assigned to one job menu among job menus to be executed before opening of a store. When change reserve amount setting processing is selected, among the job menus before opening of a store, which are displayed on the touch panel 107, the CPU 101 starts information processing of the procedures illustrated in the flowchart of FIG. 9.

First, in Act 31, the CPU 101 initializes all of the values F1 to F10 of the number-of-discharge field and the values G1 to G10 of the number-of-deposit field in the number-of-discharge-and-deposit table 74, with "0".

Next, in Act 32, the CPU 101 reads the change machine balance table 50 from the auxiliary storage device 104. In addition, in Act 33, the CPU 101 reads the change reserve amount table 60 from the auxiliary storage device 104. At this point in time, in the change machine balance table 50, data updated by change machine balance update processing which is executed after closing of a store on the previous business day, is stored. On the other hand, in the number-of-bills-and-coins field of the change reserve amount table 60, the number-of-each-denomination b1 to b10, which are set as the change reserve amount, are set. In addition, based on the number-of-each-denomination b1 to b10, an amount of money for each denomination and the change reserve amount B are calculated and set in the change reserve amount table 60.

In Act 34, the CPU 101 sets a variable n of the variable memory 75 to "0". Next, in Act 35, the CPU 101 adds up the variable n by 1. In Act 36, the CPU 101 confirms whether or not the variable n exceeds the maximum value "10" of the denomination number.

When the variable n does not exceed the maximum value 10 of the denomination number (NO in Act 36), in Act 37, the CPU 101 acquires a value indicating a denomination of a record of a denomination number n, from the number-of-discharge-and-deposit table 74. Then, the CPU 101 replaces a variable m in the variable memory 75 with a value indicating the denomination. For example, when the variable n is "1", that is, the denomination number is "1", the variable m is replaced with the value "10000" indicating the denomination.

In Act 38, the CPU 101 confirms whether or not the variable m is "2000". When the variable m is "2000" (YES in Act 38), the CPU 101 returns to the process of Act 35 without executing the process of Act 38 and the subsequent processes.

In Act 38, when it is confirmed that the variable m is not "2000" (NO in Act 38), in Act 39, the CPU 101 acquires a value an of the number-of-bills-and-coins field of the record of the denomination number matching with the variable n, from the change machine balance table 50. Then, the CPU 101 replaces a variable r in the variable memory 75 with the value an. Similarly, in Act 40, the CPU 101 acquires a value bn of the number-of-bills-and-coins field of the record of the denomination number matching with the variable n, from the change reserve amount table 60. Then, the CPU 101 replaces a variable s in the variable memory 75 with the value bn. The CPU 101 may firstly replace a variable s in the variable memory 75 with the value bn, and then replace a variable r in the variable memory 75 with the value an.

When the process of Act 39 and the process of Act 40 are ended, in Act 41, the CPU 101 confirms whether or not the variable r and the variable s are equal. When the variable r and the variable s are equal (YES in Act 41), the CPU 101 returns to the process of Act 35 without executing the process of Act 42 and the subsequent processes.

On the other hand, when the variable r and the variable s are not equal (NO in Act 41), in Act 42, the CPU 101 confirms whether or not the variable r is greater than the variable s. When the variable r is greater than the variable s (YES in Act 42), in Act 43, the CPU 101 replaces a value of the number-of-discharge field corresponding to the variable n in the number-of-discharge-and-deposit table 74, that is, so-called a number-of-discharge Fn, with a value obtained by subtracting the variable s from the variable r. On the other hand, when the variable r is less than the variable s (NO in Act 42), in Act 44, the CPU 101 replaces the number-of-discharge Fn, with a value obtained by subtracting the variable r from the variable s.

In this way, when the process of Act 43 or the process of Act 44 is ended, the CPU 101 returns to the process of Act 35.

Thereafter, the CPU 101 repeatedly executes the processes of Act 36 to Act 44 each time the variable n is counted up by "1" in Act 35. When the variable n exceeds the maximum value "10" of the denomination number (YES in Act 36), the CPU 101 proceeds to the process of Act 51 of FIG. 10. In other words, in Act 51, the CPU 101 creates a change reserve amount setting screen, based on the data of the change machine balance table 50, the data of the change reserve amount table 60, and the data of the number-of-discharge-and-deposit table 74. Then, in Act 52, the CPU 101 causes the touch panel 107 to display the change reserve amount setting screen.

Figure 13:
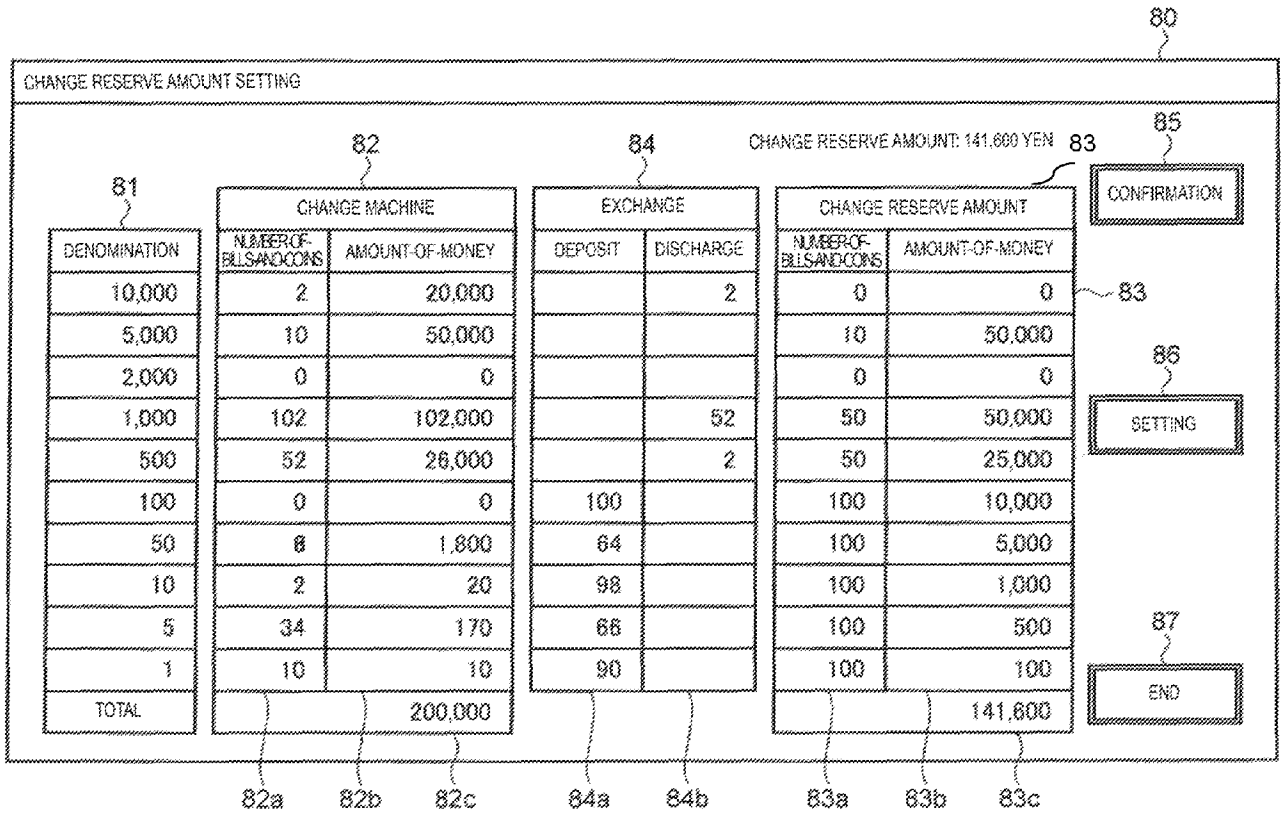
FIG. 13 is a diagram illustrating an example of a screen displayed on a display unit of the POS terminal in change reserve amount setting processing.

FIG. 13 is a display example of a change reserve amount setting screen 80. In FIG. 13, in the change reserve amount setting screen 80, the longitudinal direction is referred to as the horizontal direction, and a direction orthogonal to the longitudinal direction is referred to as the vertical direction.

As illustrated in FIG. 13, the change reserve amount setting screen 80 includes a denomination area 81, a change machine balance area 82, a change reserve amount area 83, and an exchange area 84. In addition, the change reserve amount setting screen 80 includes a confirmation button 85, a setting button 86, and an end button 87.

The denomination area 81 is disposed at a left end portion on the screen 80. The denomination area 81 is configured with 12 cells disposed side by side along the vertical direction of the screen 80. On the screen 80, the character "denomination" is displayed in the uppermost cell and the character "total" is displayed in the lowermost cell. In the other cells, in order from the top cell on the screen, values indicating denominations are displayed in descending order of the amount of money.

The change machine balance area 82 is disposed at the right side of the denomination area 81. The change machine balance area 82 is configured with 13 cells having the same size as the cells of the denomination area 81 in the vertical direction. The 13 cells are disposed side by side along the vertical direction of the screen 80, and 12 cells excluding the uppermost cell among the cells are disposed in parallel with the 12 cells of the denomination area 81. In addition, 11 cells excluding the uppermost cell and the lowermost cell are divided into two in the horizontal direction. In the uppermost cell, the words "change machine balance" may be displayed. In the second cell from the top, the words "number of bills and coins" is displayed on the left side of the screen, and the words "amount of money" is displayed on the right side of the screen. From the third cell from the top to the second cell from the bottom, on the left side 82*a* of the cells, the number of denominations in the change machine balance amount is displayed as being disposed in parallel with the denominations displayed in the cells of the denomination area 81, and on the right side 82*b*, the amounts of money of the same denominations in the change machine balance amount are displayed. Further, in the lowermost cell 82*c*, the total amount of money of each denomination in the change machine balance amount is displayed. Additionally, in the change machine balance amount, the number of each denomination, the amount of money of each denomination, and the total amount of money of the denominations are included in the data stored in the change machine balance table 50.

The change reserve amount area 83 is disposed on the right side of the screen 80 at a certain distance from the right end. The confirmation button 85, the setting button 86, and the end button 87 are disposed between the right end of the screen 80 and the change reserve amount area 83.

The change reserve amount area 83 is configured with 13 cells similarly to the change machine balance area 82. The 13 cells are disposed side by side along the vertical direction of the screen 80 in parallel with each cell of the change machine balance area 82. In addition, 11 cells excluding the uppermost cell and the lowermost cell are divided into two in the horizontal direction. In the uppermost cell, the words "change reserve amount" is displayed. In the second cell from the top, the words "number of bills and coins" is displayed on the left side of the screen, and the words "amount of money" is displayed on the right side of the screen. From the third cell from the top to the second cell from the bottom, on the left side 83*a* of the cells, the number of denominations in the change reserve amount is displayed as being disposed in parallel with the denomination displayed in the cell of the denomination area 81, and on the right side 83*b*, the amount of money of the same denomination in the change reserve amount is displayed. Further, in the lowermost cell 83*c*, the total amount of money of each denomination in the change reserve amount is displayed. Additionally, in the change reserve amount, the number of each denomination, the amount of money of each denomination, and the total amount of money of the denominations are included in the data stored in the change reserve amount table 60.

The exchange area 84 is disposed between the change machine balance area 82 and the change reserve amount area 83. The exchange area 84 is configured with 12 cells having the same width as the cells of the denomination area 81 in the vertical direction. The 12 cells are disposed side by side along the vertical direction of the screen 80, and 11 cells excluding the uppermost cell among the cells are disposed in parallel with the 11 cells from the top of the denomination area 81. In addition, 10 cells excluding the uppermost cell are divided into two in the horizontal direction. In the uppermost cell, the word "exchange" is displayed. In the second cell from the top, the word "deposit" is displayed on the left side of the screen, and the word "discharge" is displayed on the right side of the screen. From the third cell from the top to the lowermost cell, on the left side 84*a* of the cells, the number of deposit of denominations is displayed as being disposed in parallel with the denomination displayed in the cell of the denomination area 81, and on the right side 84*b*, the number of discharge of the same denominations is displayed. Additionally, the number of deposit of each denomination and the number of discharge of each denomination are included in the data stored in the number-of-discharge-and-deposit table 74.

Here, in the process of Act 51 (FIG. 10), the CPU 101 is programmed to function as a screen creation section in the following manner. The CPU 101 creates the change reserve amount setting screen 80 including a first area (the change machine balance area 82) that displays the number of bills and coins for each denomination, a second area (the change reserve amount area 83), and a third area (the exchange area 84). In addition, in the process of Act 52, the CPU 101 is programmed to function as a display control section in the following manner. The CPU 101 displays, in the first area, the number of bills and coins stored in storage units (the coin box 401 and the bill box 402) for each denomination. In addition, the CPU 101 displays, in the second area, the number of bills and coins to be stored in the storage units for each denomination, as a change reserve amount. Further, the CPU 101 displays, in the third area, the number of bills and coins according to the difference between the number of bills and coins that is displayed in the first area and the number of bills and coins that is displayed in the second area, for each denomination.

More specifically, the CPU 101 divides the third area into an area 84*a* and an area 84*b*, and when the number of bills and coins that is displayed in the second area is greater than the number of bills and coins that is displayed in the first area, displays, in the area 84*a*, the number of bills and coins according to the difference, as the number of deposit. In addition, when the number of bills and coins that is displayed in the second area is less than the number of bills and coins that is displayed in the first area, the CPU 101 displays, in the area 84*b*, the number of bills and coins according to the difference, as the number of discharge.

Further, the CPU 101 creates the change reserve amount setting screen 80 in which the first area and the second area are respectively divided into the number-of-bills-and-coins areas 82*a* and 83*a* and the amount-of-money areas 82*b* and 83*b*. Then, the CPU 101 displays, in the number-of-bills-and-coins areas 82*a* and 83*a*, the number of bills and coins stored in the storage units, or the number of bills and coins, which are stored in the storage units as a change reserve amount, for each denomination. In addition, the CPU 101 displays, in the amount-of-money areas 82*b* and 83*b*, amounts of money obtained by multiplying the number of the denominations by the amounts of money of the denominations, for each denomination.

In addition, the CPU 101 creates the change reserve amount setting screen 80 in which total areas 82*c* and 83*c* are respectively added to the first area and the second area. Then, the CPU 101 displays, in the total area 82*c* of the first area, the total amounts of money displayed in the amount-of-money area 82*b* of the first area. Further, the CPU 101 displays, in the total area 83*c* of the second area, the total amounts of money displayed in the amount-of-money area 83*b* of the second area.

In Act 52 of FIG. 10, when the change reserve amount setting screen 80 is displayed on the touch panel 107, in the Act 53, the CPU 101 confirms whether or not the setting button 86 of the screen 80 is input (touched). The setting button 86 is a button for instructing change of the change reserve amount by an operator.

When the setting button 86 is not input (NO in Act 53), in Act 54, the CPU 101 confirms whether or not the end button 87 of the screen 80 is input. The end button 87 is a button for instructing the end of change reserve amount setting processing by an operator.

When the end button 87 is not input (NO in Act 54), in Act 55, the CPU 101 confirms whether or not the confirmation button 85 of the screen 80 is input. The confirmation button 85 is a button for instructing confirmation of the change reserve amount by an operator.

When the confirmation button 85 is not input (NO in Act 55), the CPU 101 returns to the process of Act 53. That is, in the processes of Act 53 to Act 55, the CPU 101 waits for input of any one of the setting button 86, the end button 87, and the confirmation button. Here, in the processes of Act 53 to Act 55, the CPU 101 is programmed to function as a reception section that receives confirmation input of information displayed on the display unit.

In the standby state of Act 53 to Act 55, when it is detected that the setting button 86 is input (touched) based on a signal from the touch panel 107 (YES in Act 53), the CPU 101 returns the process of Act 33 of FIG. 9. Then, the CPU 101 reads a change reserve amount table 60*x*, from the auxiliary storage device 104. In the change reserve amount table 60*x*, the number of bills and coins of at least a part of the denominations is different from that of the change reserve amount table 60 (FIG. 5). In the auxiliary storage device 104, apart from the default change reserve amount table 60 which is read in the process of initial Act 33, a change reserve amount table 60*x* which is read in the process of Act 33 from the second time, is prepared.

When the change reserve amount table 60*x* is read in Act 33, the CPU 101 executes the process of Act 34 and the subsequent processes, in the same manner as described above.

On the other hand, in the standby state of Act 53 to Act 55, when it is detected that the confirmation button 85 is input (touched) based on a signal from the touch panel 107 (YES in Act 55), in Act 56, the CPU 101 displays a confirmation dialog screen by superimposing the confirmation dialog screen on the change reserve amount setting screen 80 of the touch panel 107. On the confirmation dialog screen, a "Yes" button and a "No" button are displayed together with a message inquiring execution of setting of a change reserve amount. Thus, the operator who confirms the confirmation dialog screen touches the "Yes" button when execution of setting of a change reserve amount is desired, and touches the "No" button when execution of setting of a change reserve amount is not desired.

When the confirmation dialog screen is displayed, in Act 57, the CPU 101 confirms whether or not execution of setting of a change reserve amount is desired. Here, when it is detected that the "NO" button is touched, that is, when execution of setting of a change reserve amount is not desired (NO in ACT 57), the CPU 101 cancels the confirmation dialog screen and returns to the process of Act 53. Then, the CPU 101 again waits for input of any one of the setting button 86, the end button 87, and the confirmation button 85.

On the other hand, when it is detected that the "Yes" button is touched, that is, when execution of setting of a change reserve amount is desired (YES in Act 57), in Act 58, the CPU 101 issues a setting receipt for setting a change reserve amount by controlling the printer 108. On the setting receipt, at least information of the denomination area 81 and information of the exchange area 84 of the change reserve amount setting screen 80 are printed. The information on at least one of the change machine balance area 82 and the change reserve amount area 83 may be further printed on the setting receipt.

In addition, in Act 59, the CPU 101 executes discharge processing. In other words, the CPU 101 generates discharge data including the number-of-discharge F1 to F10 of each denomination that are stored in the number-of-discharge-and-deposit table 74. The CPU 101 transmits the discharge data to the change machine 40 via the change machine interface 111.

The CPU 101 may firstly execute discharge processing and then issue the setting receipt.

Here, in execution of the process of Act 59, under the condition that the confirmation input is received, the CPU 101 is programmed to function as a discharge control section that generates the discharge data indicating the number of bills and coins to be discharged from the storage unit (coin box 401 or bill box 402), according to the difference displayed in the third area (exchange area 84), for the denomination in which the number of bills and coins displayed in the second area (change reserve amount area 83) is less than the number of bills and coins displayed in the first area (change machine balance area 82), and then transmits the discharge data to the change machine 40 via the change machine interface 111.

When the processes of Act 58 and Act 59 are ended, in Act 60, the CPU 101 cancels the change reserve amount setting screen 80 from the touch panel 107. Thus, change reserve amount setting processing is ended.

On the other hand, in the standby state of Act 53 to Act 55, when it is detected that the end button 87 is input (touched) based on a signal from the touch panel 107 (YES in Act 54), the CPU 101 proceeds to the process of Act 60 without executing the processes of Act 56 to Act 59. Then, the CPU 101 cancels the change reserve amount setting screen 80 from the touch panel 107. Thus, change reserve amount setting processing is ended.

In this manner, at a store where the POS system 1 according to the present embodiment is provided, after closing of the store, each POS terminal 10 executes change machine balance collection processing. According to the execution, in the storage units (coin box 401 and the bill box 402) of the change machine 40 connected to each POS terminal 10, money (coins or bills) corresponding to the post-collection balance amount C stored in the post-collection balance amount memory 71 of the POS terminal 10, can remain. Therefore, after closing the store, the change machine 40 can be used instead of a safe.

On the other hand, before opening of the store, each POS terminal 10 executes change reserve amount setting processing. According to the execution, the change reserve amount setting screen 80 is displayed on the display unit (touch panel 107) of each POS terminal 10. Therefore, for example, from the information on the change reserve amount setting screen 80, a store manager can recognize the balance amount at this time (the number of bills and coins and the amount of money) of the change machine 40 for each denomination. In addition, it is possible to recognize the number of bills and coins and the amount of money required as a change reserve amount for each denomination. Further, it is also possible to recognize the number of discharge and the number of deposit required for making the balance of the change machine 40 match with the change reserve amount, for each denomination. That is, it is easy to recognize whether the bills and coins stored in the storage units are insufficient or excessive as a change reserve amount. Therefore, when preparing the change reserve amount, it is sufficient to prepare the change reserve amount based on the information of the change reserve amount setting screen 80, and thus it is possible to facilitate the preparation work.

Further, in each POS terminal 10, when the confirmation button 85 of the change reserve amount setting screen 80 is touched, bills and coins corresponding to the number of discharge displayed in the area 84*b* of the exchange area 84, are automatically discharged from the change machine 40. Therefore, it is possible to easily discharge bills and coins according to an excess amount of a change reserve amount, from the change machine 40.

Hereinafter, other embodiments will be described.

In the embodiment, the exchange area 84 of the change reserve amount setting screen 80 is divided into an area 84*a* and an area 84*b*, the number of deposit is displayed in the area 84*a* on one side, and the number of discharge is displayed in the area 84*b* on the other side. In another embodiment, instead of dividing the exchange area 84, the number of deposit and the number of discharge are displayed in the same row. Here, the number of discharge can be distinguished from the number of deposit by, for example, attaching a minus sign to the number of discharge. In this way, it is possible to reduce the size of the change reserve amount setting screen 80 in the horizontal direction.

In the embodiment, the CPU 101 of the POS terminal 10 executes information processing according to the procedures in the flowcharts of FIGS. 7 to 10. In another embodiment, the store server 20 collects information of the change machine balance table 50, from each POS terminal 10, and executes information processing according to the procedures illustrated in the flowcharts of FIGS. 7 to 10. According to the another embodiment, it is possible to simplify work after closing of a store and work before opening of a store required for each POS terminal 10.

In the embodiment, the POS terminal 10 manages the change machine 40 that handles bills and coins. In another embodiment, the change machine connected to the POS terminal 10 is divided into a bill change machine that handles only bills and a coin change machine that handles only coins. Even in this case, the POS terminal 10 executes, for each of the bill change machine and the coin change machine, information processing according to the procedures illustrated in the flowcharts of FIGS. 7 to 10, and thus the same operations and effects as those of the above-described embodiment can be obtained.

The POS terminal 10 or the store server 20 functioning as a change machine management apparatus, is generally installed in a state where a program such as a change machine management program is stored in the ROM. However, this configuration is not limited thereto, and according to an operation by a user or the like, a change machine management program or the like may be written in a writable storage device included in a computer apparatus by being individually installed from the computer apparatus. The change machine management program or the like may be installed by recording the program on a removable recording medium or by communication via a network. The recording medium may be in any form such as a CD-ROM or a memory card, as long as the recording medium can store a program and is readable by the apparatus. In addition, the function obtained by installing or downloading a program may be a function which is realized by cooperating with an OS (operating system) or the like inside the apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A change machine management apparatus comprising:

an interface configured for connection with a change machine that discharges money stored in a storage unit based on discharge data received through the interface;

a display unit; and a processor programmed to create a screen display on the display unit including a first area, a second area, and a third area, each of which displays a number of bills and coins for each denomination, and control the display unit to display in the first area, the number of bills and coins stored in the storage unit for each denomination, display in the second area, the number of bills and coins to be stored as a change reserve amount in the storage unit for each denomination, and display in the third area, the number of bills and coins for each denomination according to a difference between the number of bills and coins displayed in the first area and the number of bills and coins displayed in the second area.

2. The apparatus according to claim 1, wherein, when the number of bills and coins displayed in the second area is greater than the number of bills and coins displayed in the first area, the processor controls the display unit to display in the third area, the number of bills and coins for each denomination according to the difference, as an amount of deposit.

3. The apparatus according to claim 2, wherein, when the number of bills and coins displayed in the second area is less than the number of bills and coins displayed in the first area, the processor controls the display unit to display in the third area, the number of bills and coins for each denomination according to the difference, as an amount of discharge.

4. The apparatus according to claim 1, wherein each of the first area and the second area of the screen display is divided into a number-of-bills-and-coins area and an amount-of-money area.

5. The apparatus according to claim 4, wherein the processor is programmed to control the display unit to display in the number-of-bills-and-coins area, the number of bills and coins for each denomination, and to display in the amount-of-money area, the amount of money obtained by multiplying the amount of money of the denomination by the number of the denomination, for each denomination.

6. The apparatus according to claim 4, wherein each of the first area and the second area includes a total area, and wherein the processor is programmed to control the display unit to display in the total area of the first area, the total amount of money displayed in the amount-of-money area of the first area, and in the total area of the second area, the total amount of money displayed in the amount-of-money area of the second area.

7. The apparatus according to claim 1, wherein wherein the processor, in response to a confirmation input that confirms information display on the display unit, generates the discharge data indicating the number of bills and coins to be discharged, according to the difference displayed in the third area for the denomination of which the number of bills and coins displayed in the second area is less than the number of bills and coins displayed in the first area.

8. The apparatus according to claim 1, further comprising:

a printer for printing a record including a portion of the information contained on the screen display.

9. A point-of-sale system comprising:

a change machine that discharges money stored in a storage unit based on discharge data;

a display unit; and a processor programmed to create a screen display on the display unit including a first area, a second area, and a third area, each of which displays a number of bills and coins for each denomination, and control the display unit to display in the first area, the number of bills and coins stored in the storage unit for each denomination, display in the second area, the number of bills and coins to be stored as a change reserve amount in the storage unit for each denomination, and display in the third area, the number of bills and coins for each denomination according to a difference between the number of bills and coins displayed in the first area and the number of bills and coins displayed in the second area, wherein the processor, in response to a confirmation input that confirms information display on the display unit, generates the discharge data indicating the number of bills and coins to be discharged, according to the difference displayed in the third area for the denomination of which the number of bills and coins displayed in the second area is less than the number of bills and coins displayed in the first area.

10. The system according to claim 9, wherein, when the number of bills and coins displayed in the second area is greater than the number of bills and coins displayed in the first area, the processor controls the display unit to display in the third area, the number of bills and coins for each denomination according to the difference, as an amount of deposit.

11. The system according to claim 10, wherein, when the number of bills and coins displayed in the second area is less than the number of bills and coins displayed in the first area, the processor controls the display unit to display in the third area, the number of bills and coins for each denomination according to the difference, as an amount of discharge.

12. The system according to claim 9, wherein each of the first area and the second area of the screen display is divided into a number-of-bills-and-coins area and an amount-of-money area.

13. The system according to claim 12, wherein the processor is programmed to control the display unit to display in the number-of-bills-and-coins area, the number of bills and coins for each denomination, and to display in the amount-of-money area, the amount of money obtained by multiplying the amount of money of the denomination by the number of the denomination, for each denomination.

14. The system according to claim 9, further comprising:

a printer for printing a record including a portion of the information contained on the screen display.

15. A method of operating a change machine management apparatus including an interface connected to a change machine that discharges money stored in a storage unit based on discharge data received through the interface, and a display unit, the method comprising:

creating a screen display for display on the display unit, the screen display including a first area, a second area, and a third area, each of which displays a number of bills and coins for each denomination; and displaying in the first area, the number of bills and coins stored in the storage unit for each denomination, displaying in the second area, the number of bills and coins to be stored as a change reserve amount in the storage unit for each denomination, and displaying in the third area, the number of bills and coins for each denomination according to a difference between the number of bills and coins displayed in the first area and the number of bills and coins displayed in the second area.

16. The method of claim 15, wherein, when the number of bills and coins displayed in the second area is greater than the number of bills and coins displayed in the first area, displaying in the third area, the number of bills and coins for each denomination according to the difference, as an amount of deposit.

17. The method of claim 15, wherein, when the number of bills and coins displayed in the second area is less than the number of bills and coins displayed in the first area, displaying in the third area, the number of bills and coins for each denomination according to the difference, as an amount of discharge.

18. The method of claim 15, wherein each of the first area and the second area of the screen display is divided into a number-of-bills-and-coins area and an amount-of-money area.

19. The method of claim 18, further comprising:

displaying in the number-of-bills-and-coins area, the number of bills and coins for each denomination, and in the amount-of-money area, the amount of money obtained by multiplying the amount of money of the denomination by the number of the denomination, for each denomination.

20. The method of claim 15, further comprising:

in response to a confirmation input that confirms information display on the display unit, generating the discharge data indicating the number of bills and coins to be discharged, according to the difference displayed in the third area for the denomination of which the number of bills and coins displayed in the second area is less than the number of bills and coins displayed in the first area, and transmitting the discharge data to the change machine through the interface.

* * * * *